US005775561A

United States Patent [19]

Kennedy

[11] Patent Number: 5,775,561

[45] Date of Patent: Jul. 7, 1998

[54] WATERPROOF SWIMMING POUCH

[76] Inventor: Linda Kennedy, P.O. Box 680398, Park City, Utah 84068

[21] Appl. No.: 866,917

[22] Filed: May 30, 1997

Related U.S. Application Data

[62] Division of Ser. No. 183,918, Jan. 19, 1994, Pat. No. 5,645,205, which is a continuation of Ser. No. 803,128, Dec. 4, 1991.

[51] Int. Cl.[6] ..... A45F 3/00

[52] U.S. Cl. ..... 224/676; 224/664; 224/667; 224/669; 224/677; 224/934; 383/63; 383/111; 383/113; D3/221; D3/226; D3/230; D3/319

[58] Field of Search ..... 224/235, 240, 224/664, 667, 669, 676, 677, 934; 383/111, 113, 63, 901; D3/215, 221, 226, 230, 319

[56] References Cited

U.S. PATENT DOCUMENTS

| | | | |
|---|---|---|---|
| D. 261,196 | 10/1981 | Griffin . | |
| D. 265,149 | 6/1982 | Romano | D3/319 |
| D. 278,761 | 5/1985 | Fuller . | |
| D. 334,471 | 4/1993 | Yerby et al. | D3/226 |
| 1,559,270 | 10/1925 | Miller | 224/676 |
| 1,920,061 | 7/1933 | Carr | 224/235 X |
| 2,072,564 | 3/1937 | May | 383/111 X |
| 2,107,216 | 2/1938 | Rogers | 383/113 X |
| 3,485,281 | 12/1969 | Wicks | 383/111 X |
| 3,980,070 | 9/1976 | Krupa | 383/111 X |
| 4,420,097 | 12/1983 | Motsenbocker | 224/148 |
| 4,637,063 | 1/1987 | Sullivan et al. | 383/113 X |
| 4,871,597 | 10/1989 | Hobson . | |
| 4,905,857 | 3/1990 | Her . | |
| 4,951,666 | 8/1990 | Inman et al. | 383/901 X |
| 5,012,964 | 5/1991 | Falletta et al. | 224/153 |
| 5,060,835 | 10/1991 | Payne | 224/224 |
| 5,074,300 | 12/1991 | Murphy | 383/901 X |
| 5,096,103 | 3/1992 | Baugh | 224/151 |
| 5,114,061 | 5/1992 | Brady | 224/252 |
| 5,150,824 | 9/1992 | Alvarez et al. | 224/151 |

FOREIGN PATENT DOCUMENTS

| | | | |
|---|---|---|---|
| 1078797 | 6/1980 | Canada | 224/240 |
| 2522484 | 9/1983 | France | D3/226 |
| 2590458 | 5/1987 | France | 224/153 |

OTHER PUBLICATIONS

Fanny Pack and Insulated Container, Bass Pro Shops Catalog, 1990, p. 356.

Various Fanny Packs, Bow Hunters Catalog, Spring, 1986, p. 66.

Fanny Pack PB–9, M.G.B. Industrial Co., Ltd. Advertisement, Hong Kong Enterprises Magazine, Oct., 1989, p. 485.

*Primary Examiner*—Stephen Cronin

*Attorney, Agent, or Firm*—John F. A. Earley; John F. A. Earley, III; Harding, Earley, Follmer & Frailey

[57] ABSTRACT

A lightweight waterproof pouch for carrying personal objects such as cash, a watch, credit cards, a wallet, and the like in a wet environment and for keeping those objects safe and dry comprises an outer enclosure formed of flexible material, a removable, resealable, waterproof inner pouch liner for insertion into the outer enclosure, and a strap attached to the outer enclosure for holding the pouch around a wearer's body. The inner pouch liner forms a watertight compartment when closed for keeping the personal objects dry.

11 Claims, 2 Drawing Sheets

WATERPROOF SWIMMING POUCH

This is a divisional of application Ser. No. 08/183,918 filed on Jan. 19, 1994, which is a continuation of application Ser. No. 07/803,128 filed Dec. 4, 1991.

1. Field of Invention

The present invention relates to a comfortable and safe way to carry personal belongings in a nonbreakable waterproof swimming pouch, enabling its users to enjoy all water activities available by allowing them to give their undivided attention to their surroundings, without the fear that usually comes with the possible theft of one's cash, watch, credit cards, and wallet when left unattended on land, and at the same time enabling its users to feel attractive while wearing the aesthetically appealing waterproof pouch with swim wear.

2. Description of Prior Art

Water sports for the water sports enthusiast are usually performed with one eye on the beach watching the personal items that have been stored on the beach in a towel, hidden in the sand or a sneaker, unless one is fortunate enough to have a friend offer to give up their fun and stay behind and act as a watch guard. Many vacationing couples split water time because there is not a lightweight, safe, convenient, shatterproof, as well as aesthetically appealing, means to carry their personal items along with them.

While a diving box may exist, Her U.S. Pat. No. 4,905,857, it will hardly be the choice of the casual swimmer or water sports enthusiast. Who would choose a cumbersome, expensive, breakable and therefore unsafe and hazardous, means to carry personal items around one's waist while actually engaging in a sport where only fun is on the mind? In addition, the diving box is strictly functional, whereas the waterproof swimming pouch is a pleasure to the eye since said waterproof swimming pouch is made in coordinating colors and patterns to swim wear, rests lightly and comfortably on the hip, almost undetected by the wearer, and acts as part of the swimming dress.

SUMMARY OF THE INVENTION

The present invention was developed out of a need to provide a means for safe keeping the personal belongings of the water sports enthusiast. The invention fulfills this need, and, at the same time, remains aesthetically appealing.

The waterproof swimming pouch is provided with an outer enclosure made of a lightweight, colored, patterned, and coordinated material such as nylon, cotton, polyester, or other known fabric materials. The enclosure material can be chosen to match all bathing apparel.

The waterproof swimming pouch is also provided with a resealable removable inner pouch liner that serves to waterproof the personal belongings of the sports enthusiast. Said inner pouch liner is made of durable waterproof material and shaped to fit the outer enclosure, and is provided with a resealable interlocking closure at the top of the inner pouch liner. Inner pouch will supply the means of water proof.

DETAILED DESCRIPTION OF THE DRAWINGS

Figure 1:
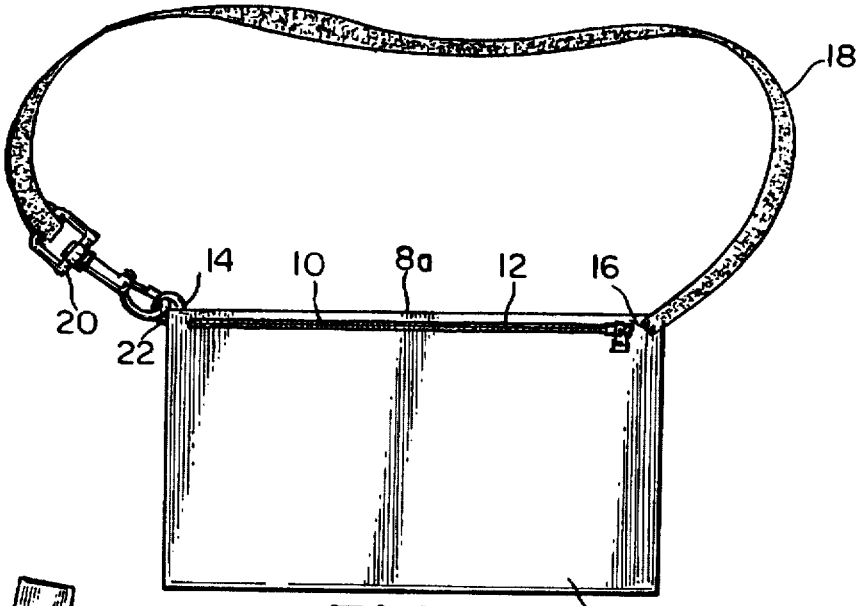
FIG. 1 is a perspective frontal view of a rectangular version of the waterproof swimming pouch constructed in accordance with the invention.

Turning to FIG. 1, enclosure 8 forms a jacket completely surrounding a waterproof resealable inner pouch liner (not shown). Enclosure 8 is formed in a rectangular shape, although any geometrical shape may be used. In the preferred embodiment, the enclosure is made of a woven fabric of a particular weave wherein the material can be cotton, nylon, polyester, or other known fabric materials. Opening 10 extends horizontally across the upper edge 8*a* of enclosure 8. Closure means 12, which in the preferred embodiment is a zipper, is fixed in opening 10 to enable opening and closing of opening 10. Snaps, buttons, or VELCRO (a trademark of VELCRO USA, Inc.) strips and other closing devices may be used as closure means 12.

Strap 18 may be made from any convenient strap material and is used to attach enclosure 8 around a wearer's waist. Strap 18 is attached to the right and left upper end portion of enclosure 8. In FIG. 1, the strap end 16 of strap 18 is sewn in place, although a buckle means may be used, and strap end 14 is attached to enclosure 8 by a buckle 20 and eye 22. Buckle 20 and eye 22 interlock with one another to secure strap end 14 to enclosure 8, and may be disengaged from each other for detaching strap end 14 from enclosure 8. Buckle 20 and eye 22 can be made in a variety of different ways as will be obvious to persons skilled in the art and may be made from conventional materials such as plastic or metals.

Figure 2:
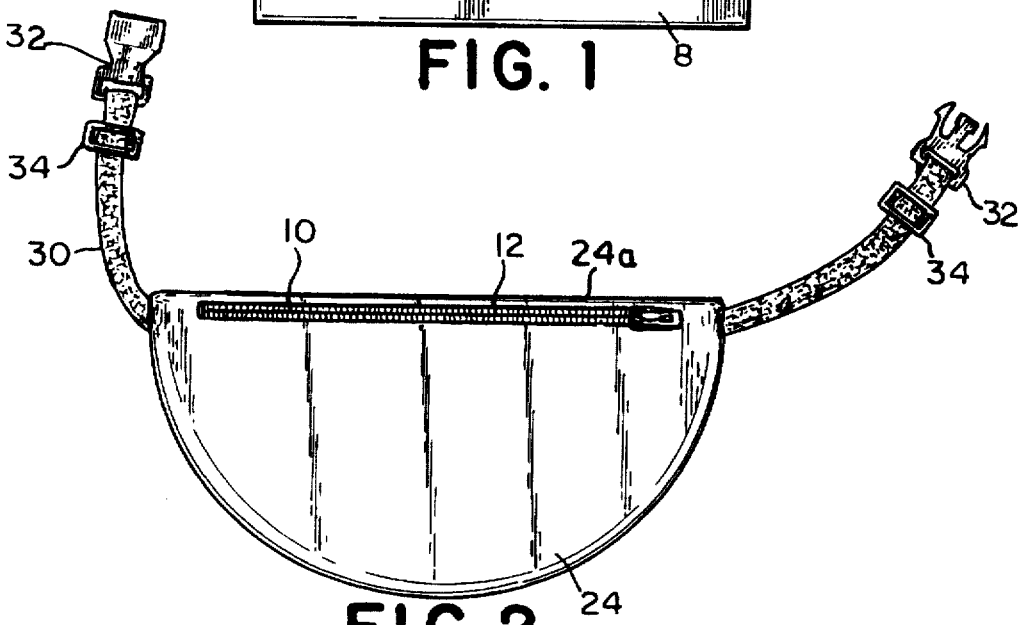
FIG. 2 is a perspective frontal view of a semicircular version of the waterproof swimming pouch constructed in accordance with the invention.

FIG. 2 shows enclosure 24 which forms a jacket completely surrounding a crescent-shaped waterproof inner pouch liner (not shown). Upper edge 24*a* of the enclosure 24 is shown with closure means 12 fixed in opening 10. Waist strap 30 is permanently attached to the enclosure left end portion and to the enclosure right end portion. The connector shown is a snap-type buckle 32 for securing the swimming pouch, and adjusters 34 are provided to allow the waist strap 30 to be shortened or lengthened. Enclosure 24 is formed in a crescent-shaped wedge, although any geometrical shape may be used.

Figure 3:
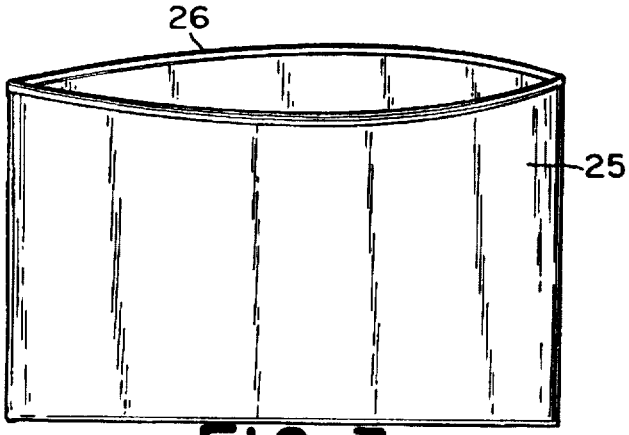
FIG. 3 is a view in perspective of a rectangular version of an inner pouch liner with resealable interlocking closure used in the waterproof swimming pouch of FIG. 1.

FIG. 3 shows an inner pouch liner 25, having a resealable interlocking closure 26. Waterproof enclosure 25 is formed in rectangular shape although any geometric shape may be used and is made of a durable waterproof plastic that has a resealable interlocking closure 26 generally known to those skilled in the art relating to closure fastening devices as demonstrated by the numerous patents in this area.

Figure 4:
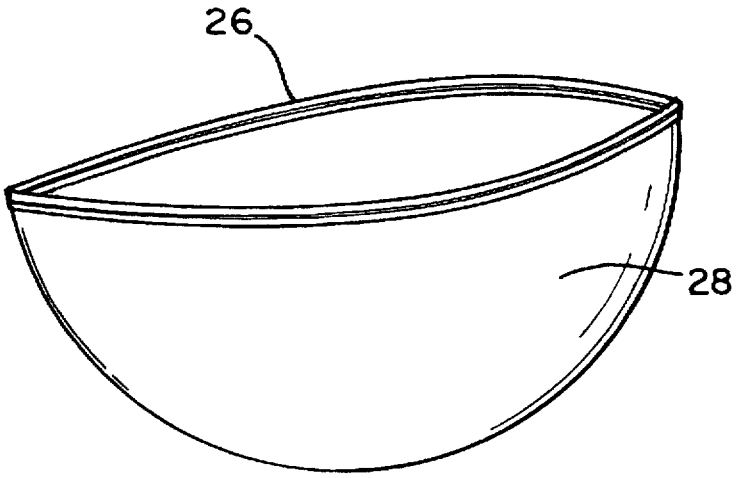
FIG. 4 is a view in perspective of a semicircular version of an inner pouch liner with resealable closure used in the waterproof pouch of FIG. 2.

FIG. 4 shows an alternative inner pouch liner 28. Enclosure 28 is formed in a crescent-shaped wedge shape, although any geometrical shape may be used, and is made of durable waterproof plastic that has resealable interlocking closure 26.

Figure 5:
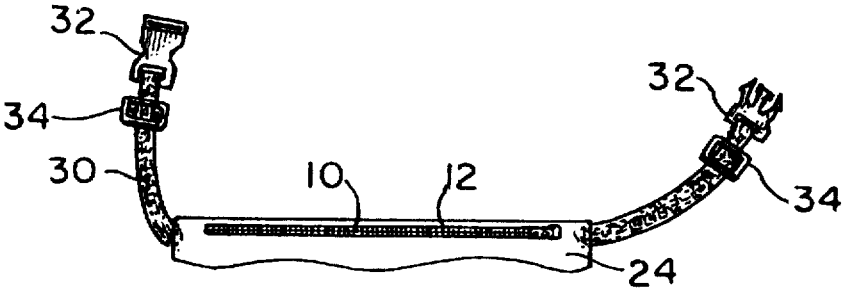
FIG. 5 is a frontal view of the upper edge portion of an inventive waterproof swimming pouch, showing the strap and connector.

FIG. 5 shows the upper edge portion of the enclosure 24, showing the fastener 12 in the form of a zipper and the strap 30 with snap-lock connector 32.

Figure 6:
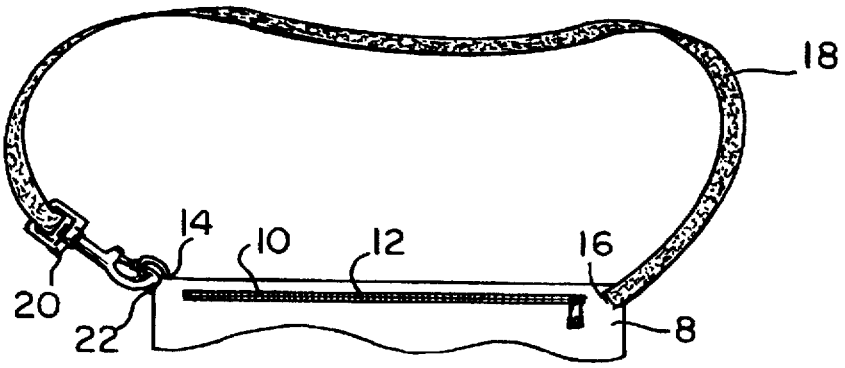
FIG. 6 is a frontal view of the upper edge portion of an inventive waterproof swimming pouch, showing an alternative strap and connector.

FIG. 6 is shows an alternative embodiment of the invention, with strap 18 being securely connected to the enclosure 8 by means of a spring-loaded swivel clip 20 and eye 22.

I claim:

1. A method of carrying personal belongings such as cash, a watch, credit cards, a wallet, and the like and of keeping the personal belongings dry while engaging in water activities, using a lightweight waterproof pouch for carrying personal belongings in a wet environment, said pouch comprising an enclosure of comfortable size formed of flexible material, the enclosure having an upper end portion, and first and second side portions, an opening formed in the upper end portion of the enclosure, closure means formed at the opening in the upper end portion of the enclosure for securely closing the opening when desired, an inner pouch liner for insertion into said enclosure, the inner pouch liner being formed of a waterproof flexible material and having an upper end portion, an opening in the upper end portion of the inner pouch liner, resealable interlocking closure means formed at the opening in the inner pouch liner for closing the opening in the inner pouch liner when desired, for forming a watertight compartment inside the inner pouch liner, and for keeping the personal belongings dry, and a flexible strap mounted on the enclosure for holding the pouch around a wearer's body, comprising the steps of inserting personal belongings into the inner pouch liner, closing the resealable interlocking closure means of the inner pouch liner to form a watertight compartment in which the personal belongings are being held, securing the closed inner pouch liner in the enclosure by closing the closure means of the enclosure, and securing the enclosure around the waist of a wearer using the flexible strap.

2. The method of claim 1, wherein the flexible material forming the enclosure is made of knitted cotton, nylon, polyester, or other known fabric material.

3. The method of claim 1, the closure means formed at the opening in the upper end portion of the enclosure comprising a zipper.

4. The method of claim 1, the resealable interlocking closure means comprising an interlocking watertight plastic strip formed along the upper end portion of the inner pouch liner.

5. The method of claim 1, the strap for securing the pouch to a wearer's body comprising a belt, a strap, or a cord.

6. The method of claim 1, the strap having a first end portion and a second end portion, and further including connection means for connecting the first end portion of the strap to the first side portion of the enclosure, and connecting-disconnecting means mounted on the second end portion of the strap and the second side portion of the enclosure for connecting the second end portion of the strap to the second side portion of the enclosure when desired to secure the pouch around a wearer's waist and for disconnecting the second end portion of the strap from the second side portion of the enclosure when desired to permit the pouch to be removed from around a wearer's waist.

7. The method of claim 6, the connecting-disconnecting means comprising a buckle and eye.

8. The method of claim 1, the strap having a first end portion and a second end portion, and further including first connection means for connecting the first end portion of the strap to the first side portion of the enclosure, second connection means for connecting the second end portion of the strap to the second side portion of the enclosure, and connecting-disconnecting means mounted on the strap between the first end portion of the strap and the second end portion of the strap for connecting a first portion of the strap to a second portion of the strap when desired to secure the pouch around a wearer's waist and for disconnecting the first portion of the strap from the second portion of the strap when desired to permit the pouch to be removed from around a wearer's waist.

9. The method of claim 8, the connecting-disconnecting means comprising snap-lock connectors.

10. A method of carrying personal belongings such as cash, a watch, credit cards, a wallet, and the like and of keeping the personal belongings dry while engaging in water activities, using a lightweight waterproof pouch for carrying personal belongings in a wet environment, said pouch comprising an enclosure of comfortable size formed of flexible material, the enclosure having an upper end portion, and first and second side portions, an opening formed in the upper end portion of the enclosure, closure means formed at the opening in the upper end portion of the enclosure for securely closing the opening when desired, an inner pouch liner for insertion into said enclosure, the inner pouch liner being formed of a waterproof flexible material and having an upper end portion, an opening in the upper end portion of the inner pouch liner, resealable inner locking closure means formed at the opening in the inner pouch liner for closing the opening in the inner pouch liner when desired, for forming a watertight compartment inside the inner pouch liner, and for keeping the personal belongings dry, a flexible strap for holding the pouch around a wearer's body, the strap having a first end portion and a second end portion, connection means for connecting the first end portion of the strap to the first side portion of the enclosure, and connecting-disconnecting means mounted on the second end portion of the strap and the second side portion of the enclosure for connecting the second end portion of the strap to the second side portion of the enclosure when desired to secure the pouch around a wearer's waist and for disconnecting the second end portion of the strap from the second side portion of the enclosure when desired to permit the pouch to be removed from around a wearer's waist, the flexible material forming the enclosure being made of knitted cotton, nylon, or polyester, the closure means formed at the opening in the upper end portion of the enclosure comprising a zipper, the resealable inner locking closure means comprising an interlocking watertight plastic strip formed along the upper end portion of the inner pouch liner, the strap for securing the pouch to a wearer's body comprising a belt, a strap, or a cord, and the connecting-disconnecting means comprising a buckle and eye, comprising the steps of inserting personal belongings into the inner pouch liner, closing the resealable interlocking closure means of the inner pouch liner to form a watertight compartment in which the personal belongings are being held, securing the closed inner pouch liner in the enclosure by closing the closure means of the enclosure, and securing the enclosure around the waist of a wearer by connecting the connecting-disconnecting means.

11. A waterproof pouch comprising, a. A geometrically shaped enclosure of comfortable size, having an opening for receiving or removing an insertable resealable waterproof pouch.

b. An insertable resealable waterproof pouch having a plastic resealable interlocking closure device for opening for receiving or removing personal belongings.

c. An attachment means provided at end of outside enclosure for detachable engagement.

d. A wearing means selected from the group consisting of waist belt, strap and cord.

* * * * *